United States Patent [19]

Wrotny et al.

[11] 4,269,165

[45] May 26, 1981

[54] OVEN HINGE

[75] Inventors: Walter A. Wrotny, Berlin, N.J.; James D. McIntosh, Philadelphia, Pa.

[73] Assignee: Mitchell Industries, Inc., Philadelphia, Pa.

[21] Appl. No.: 47,207

[22] Filed: Jun. 11, 1979

[51] Int. Cl.[3] ..... F23M 7/00; F24C 15/04

[52] U.S. Cl. ..... 126/191; 126/194

[58] Field of Search ..... 126/194, 191; 16/128; 126/192

[56] References Cited

U.S. PATENT DOCUMENTS

| | | | |
|---|---|---|---|
| 3,712,287 | 1/1973 | Summers | 126/191 |
| 3,749,080 | 7/1973 | Kleinhenn | 126/194 |
| 3,950,125 | 6/1969 | Hopkins | 126/194 |

FOREIGN PATENT DOCUMENTS

| | | | |
|---|---|---|---|
| 686472 | 12/1929 | France | 126/191 |

*Primary Examiner*—Samuel Scott

*Attorney, Agent, or Firm*—Frederick J. Olsson

[57] ABSTRACT

Composite oven door and hinge which is fixedly but detachably mounted on a stove. The door is pivotal between closed, broil and open positions and the hinge provides for counterbalancing in moving between broil and open positions.

14 Claims, 18 Drawing Figures

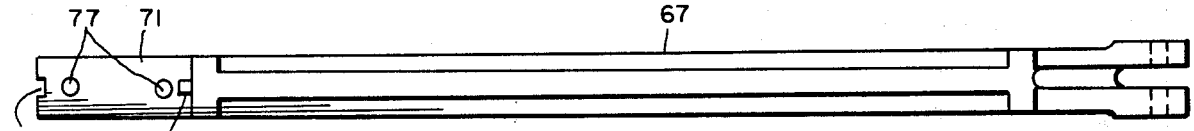
Fig. 11
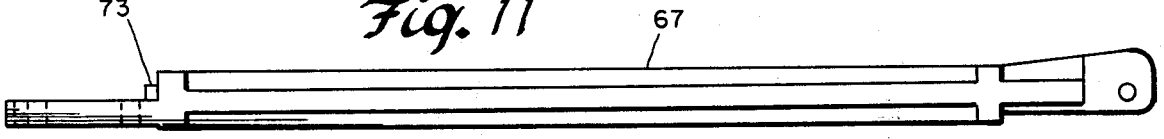
Fig. 12
Fig. 13
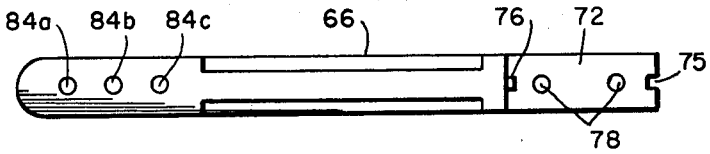
Fig. 14
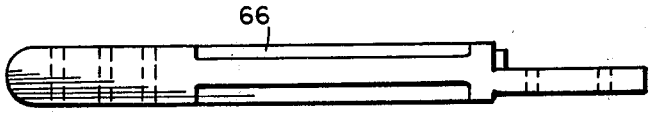
Fig. 15
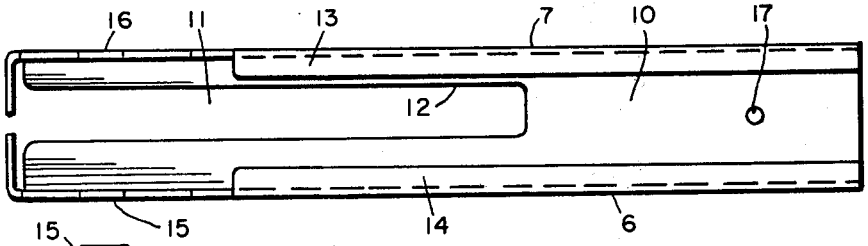
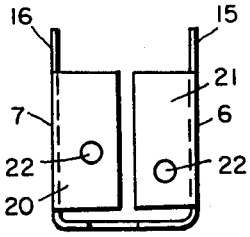
Fig. 17
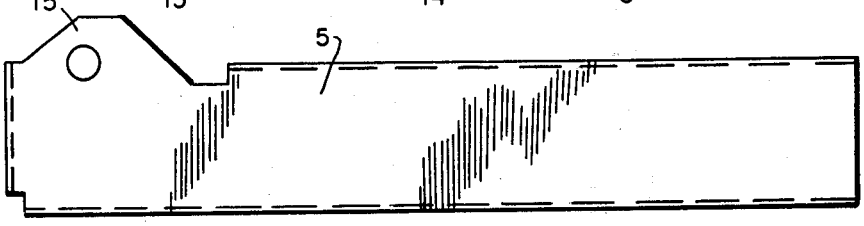
Fig. 16
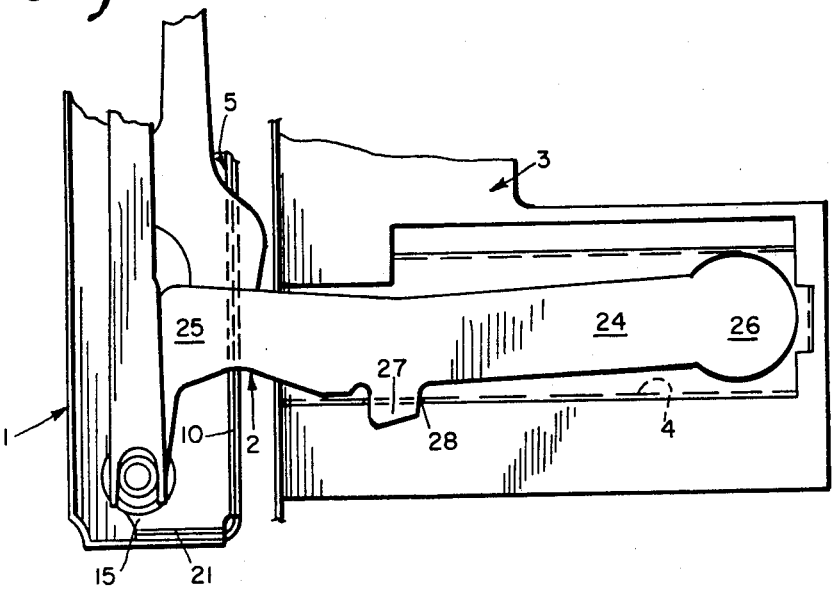
Fig. 18

OVEN HINGE

The invention relates to an improved hinge structure for mounting the access door of a cooking oven.

The hinges described herein are the type which are fixed to the door, the composite door/hinge being mountable in position by inserting portions of the hinges in sockets provided on the oven. The composite door/-hinge is removable simply by lifting out of the socket.

Examples of hinges of the kind in question are shown in U.S. patents to: Stoligrosz U.S. Pat. No. 3,072,117; Ferland U.S. Pat. No. 3,150,658; Hoppe U.S. Pat. No. 3,286,706; Doner U.S. Pat. No. 3,299,879; Smith U.S. Pat. No. 3,327,701 and Hopkins U.S. Pat. No. 3,450,125.

It is common in such arrangements for the hinge to mount the door at the bottom so as to pivotable or tiltable as between closed, broil and fully open positions and for the hinge to provide a counterbalancing force to the weight of the door over the door motion as between broil and open positions.

The principal object of the invention is to provide a hinge of the kind in question having various improved structural features which permit the hinge to be self-contained and contribute to longevity, positive operation, adaptability to doors of various weights and to reasonable cost.

The invention contemplates that the counter-balancing and positioning of the door be achieved thru a compression spring rather than a tension spring. In this way the physical size of the spring can be reduced without sacrificing required stress characteristics and this permits a smaller, compact hinge.

The compression spring is made operative thru a pair of parallel systems, one of which fixedly supports one end of the spring while the other supports and moves the opposite end of spring as a function of the pivotal position of the door so as compress or decompress the same and thus vary the force developed by the spring.

The systems provide for the transfer of spring force to the door to oppose the force developed by the weight of the door and thereby attain counterbalancing. Alternatively, the systems provide for the transfer of spring force to a detent roller which engages detents and establishes the closed and broil positions.

The invention also contemplates means for changing the spring rate to accomodate doors of varying weight and different centers of gravity by the mere change of one component. This permits an inventory of a components (of different size) rather than an inventory of custom hinges.

Additionally the hinge of the invention is arranged so the degree of spring compression can be varied over a limited range and thus provide for vernier adjustment of the spring rate.

The hinge will be described below in connection with the following drawings wherein:

FIGS. 11 and 12 are respectively plan and elevational views of the lower section of the shaft structure employed in the hinge of FIG. 1;

FIGS. 13 and 14 are respectively plan and elevational views of the upper section of shaft structure employed in the hinge of FIG. 1;

FIG. 15 is a rear view of the housing employed in the hinge of FIG. 1;

FIG. 16 is an elevational view of the housing of FIG. 15;

FIG. 17 is an end view looking toward the right in FIG. 15; and

FIG. 18 is a fragmentary elevational view illustrating how the hinge and the door carried thereby are mounted on the range or oven.

Figure 1:
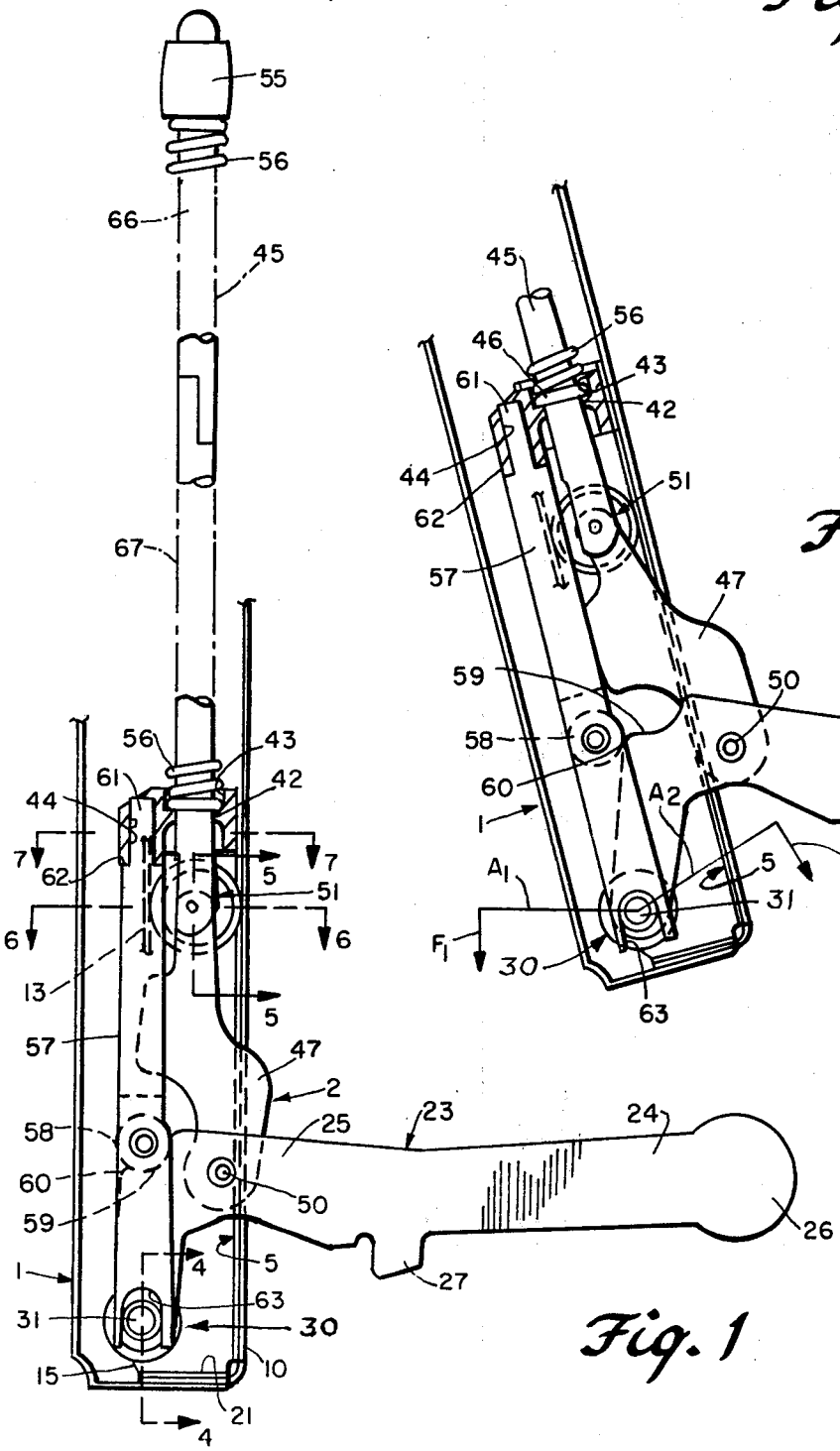
FIG. 1 is a side elevational view partially in section of a hinge embodying the invention, the hinge being in the door-closed position.

Referring to FIGS. 1 and 18 the oven door is indicated at 1 and one of the hinges secured thereto as by 2. The composite door and hinge is held on the stove 3 by the hinge cooperating with a socket 4. The door covers or uncovers the access opening (not shown) to the oven.

Figure 3:
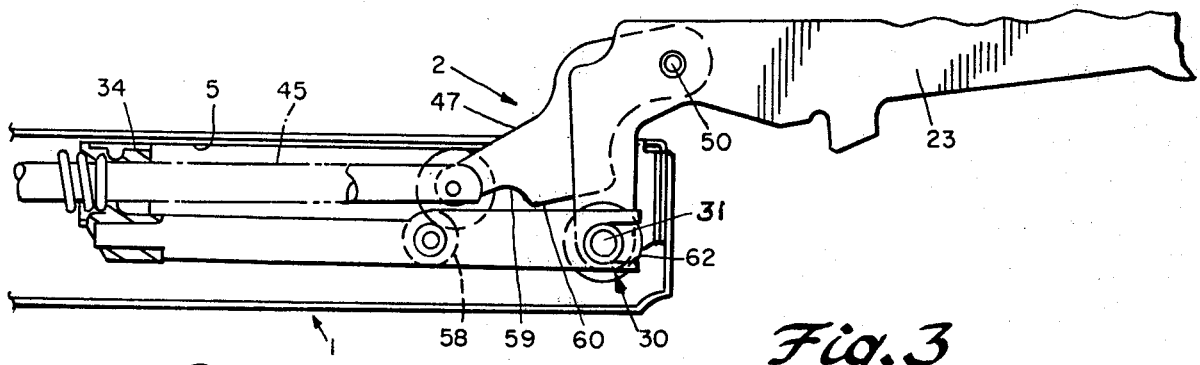
FIG. 3 is a fragmentary side elevational view of the hinge of FIG. 1 in the door-open position.
Figure 2:
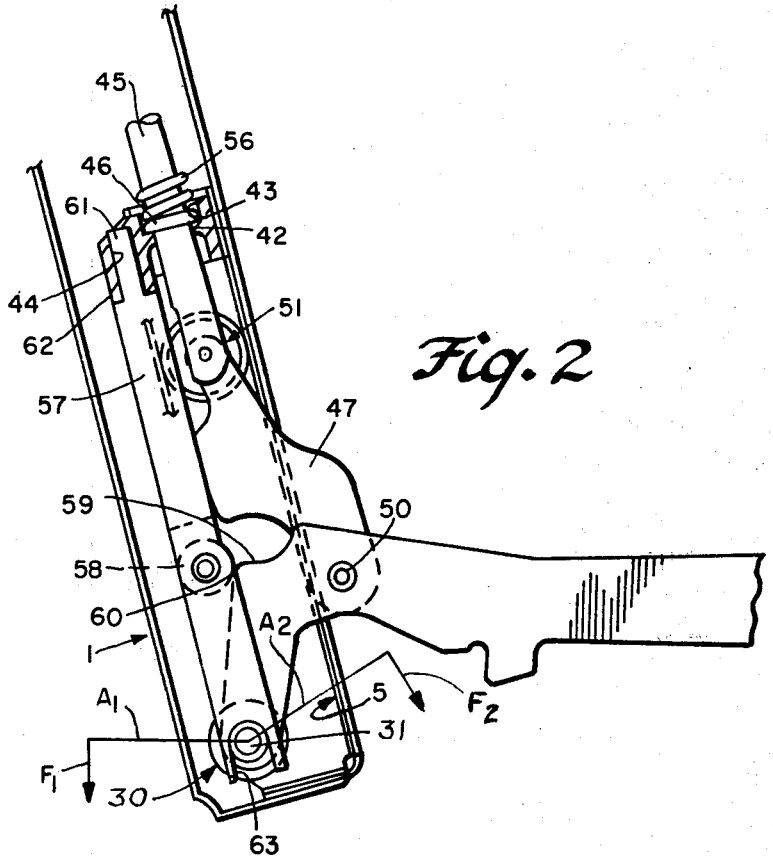
FIG. 2 is a fragmentary side elevational view of the hinge of FIG. 1 in the broil or partially open position.

The composite door and hinge are movable with respect to the oven as between a closed position shown in FIG. 1, a broil position as indicated in FIG. 2 and a fully open position as seen in FIG. 3.

The hinge 2 is self-contained by that all of the various components are mounted on a main housing 5. The housing is adapted to be slipped into a retaining structure (not detailed) in the door and locked in position normally by self-tapping screws. The general structure of the housing is shown in FIGS. 15, 16 and 17.

As noted the housing is U-shaped in cross section having a pair of sides 6 and 7, a back 10 and an open front 11. The back 10 has a slot 12 and the front has a pair of retaining flanges 13 and 14. The sides are formed with main pivot brackets 15 and 16. The back 10 has a screw hole 17 and the sides have turned-in feet 20 and 21 also having screw holes 22. The holes 17 and 22 accept self-tapping screws (not shown) by which the housing is fixed in position on the door.

An arm 23 an inboard section 24 and an outboard section 25. The inboard section 24 has a circular end 26 and a key 27 which fit into the socket 4 (FIG. 18) with the end 26 abutting the end of the socket and the key 27 fitting into a key hole 28. The socket 14 and inboard section 24 are dimensioned so that when the door is in the broil position the same can be lifted upwardly which removes the key 27 from the key hole 28. The door and hinge can then be pulled outwardly. Thus, the door and hinge are releasably or demountably held in position. The door and hinge are mounted by the reverse procedure.

The housing 5 is pivotally connected to the outboard section by the main pivot 30. This pivot permits the door and housing to pivot relative to the outboard section 25, hence the oven 3, to close, broil and open positions.

The main pivot 30 (FIG. 4) has a pin 31 mounted in the brackets 15 and 16 of the housing and a spacer 32.

The arm outboard section 25 has an aperture which envelopes the pin 31 in a snug, sliding fit. Additional components of the main pivot 30 will be noted later.

Figure 7:
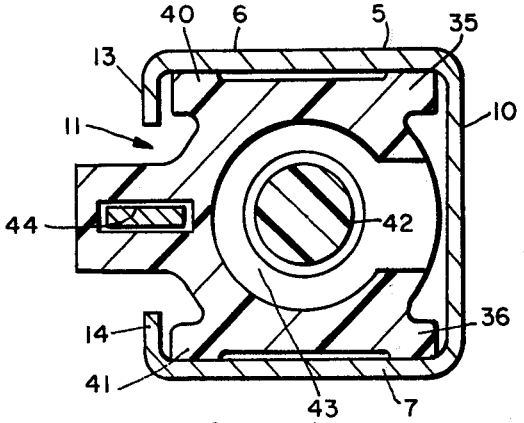
FIG. 7 is a sectional view taken along the lines 7—7 of FIG. 1.

The housing 5 carries a collar 34 which is mounted in the housing for limited axial shifting. The structure of the collar is best shown in FIGS. 2 and 7.

The collar 34 includes a pair of slider sections 35 and 36 which respectively engage the back 10 and sides 6 and 7 of the housing and a pair of slider sections 40 and 41 which respectively engage the sides 6 and 7 and flanges 13 and 14. The collar has an axially extending aperture 42 surrounded by a socket 43. The collar also has a retaining slot 44, the function of which will be noted later.

The slider sections 35/36 and 40/41 make a snug sliding fit with the housing a prevent lateral shifting of the collar but permit axial shifting. The collar moves with the housing 5 when the same pivots.

The collar 34 mounts an elongated shaft 45. A portion of the shaft extends thru the collar aperture 42 and down into the housing 5. The portion of the shaft above the collar extends upwardly into the interior of the door. It will be noted that the axis of the shaft 45 is inboard of the main pivot 30. By being confined in the collar 34, the shaft partakes of the pivoting motion of the housing, A shaft control member 47 i.e. a member which causes the shaft to move axially as function of the pivotal position of the door is connected between the fixed arm 23 and the lower end of the shaft. The control member 47 and the arm 23 both extend thru housing slot 12 and also thru an appropriate slot in the door.

A first pivot means 50 connects the lower end of the shaft control member 47 to the outboard section 25. Note that the first pivot 50 is located inboard of the axis of the shaft.

Figure 6:
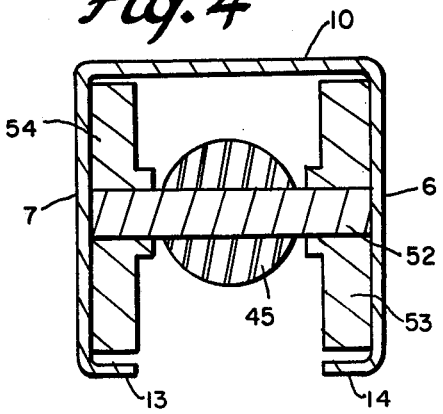
FIG. 6 is a sectional view taken along the lines 6—6 of FIG. 1.

A second pivot means 51 connects the upper end of the shaft control member 47 to the end of the shaft 45. With reference to FIG. 6, the second pivot means 51 comprises a pin 52 extending thru the end of the shaft 45 and mounting a pair of rollers 53 and 54. The rollers 53 and 54 make a snug sliding fit with the sides 6 and 7 of the housing and with the back 10 and flanges 13 and 14.

This structure confines the pivot means 51 and the end of shaft 45 against lateral shifting but permits axial motion along the housing. Also the pivot means 51 serves to transfer the force of a spring (described below) into the housing and door for counter balancing purposes.

The upper end of shaft 45 carries a retainer 55. Surrounding the shaft 45 is a spring 56. The lower end of the spring is disposed in the socket 43 of the collar 34 and the upper end engages the retainer 55. Thus, the spring is compressed between the collar and retainer.

With reference to FIGS. 1, 2, and 3 it will be seen that as the door is moved as between the closed and open positions, the shaft 45 is pulled axially downwardly (by operation of member 47) and thereby compressing the spring. When the door is moved from open to closed, the member 47 allows the shaft to move upwardly to decompress the spring. In the foregoing compression and decompression, the bottom of the spring is held fixed by the collar 34 as will be explained below.

A collar/roller control member 57 is connected between the collar 34 and the main pivot 30. A detent roller 58 for maintaining the closed and broil positions of the door is carried by the member 57. The member 57 controls the axial position of the collar 34 against the thrust of the spring 56 and also positions the roller 58 for engaging the closed position detent 59 and broil position detent 60. This will be commented on later.

The upper end of the collar/roller control member 57 has a shank 61 which has support shoulder 62. The shank is press fitted into the slot 44 on collar 34. The collar 34 is bottomed on the shoulder 62. The collar 34 and member 57 move axailly in unison.

Figure 4:
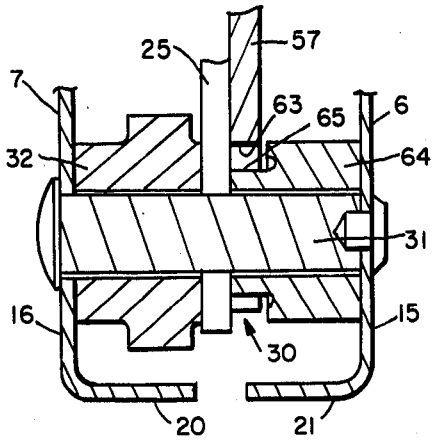
FIG. 4 is a sectional view taken along the lines 4—4 of FIG. 1.
Figure 5:
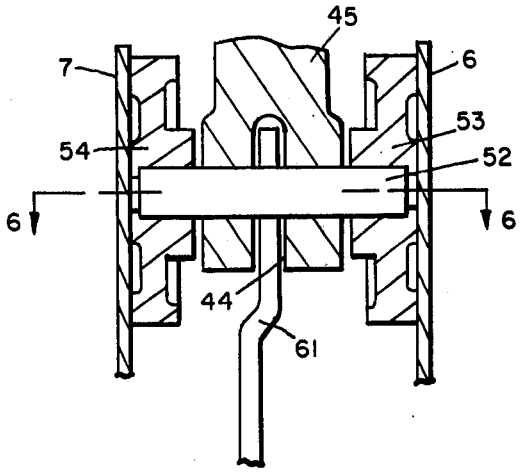
FIG. 5 is a sectional view taken along the lines 5—5 of FIG. 1.

The lower end of the collar/roller control member 57 is adapted to engage and disengage with main pivot 30 which has additional components to provide for same as noted following. With reference to FIG. 4, the member 57 is slotted at 63 and the pin 31 carries a spacer 64 which is shouldered at 65. The slot 63 makes a sliding fit with outboard section 25 and a snug sliding fit with shoulder 65 of spacer 64 and is adapted to engage and disengage with the top of the shoulder. In the closed position, the control member 57 is disengaged and in all other positions it is engaged.

As will be apparent the spacers 32 and 65 confine and position both the outboard section 25 and the member 57.

The structure of the shaft 45 provides for easy change and adjustment of the force generated by spring 56 for ready accomodation of doors of varying weight and different centers of gravity. Also, the retainer 55 can be set at several different axial positions on the shaft and this provides further change or adjustment in spring pressure. The structure for accomplishing the foregoing is explained below.

The shaft 45 has an upper part 66 and a lower part 67 which are connected at the joint 70. By selecting one of several different length upper pieces 66 to combine with the lower piece 67, the over all length of the shaft is proportionately changed and accordingly the spring pressure changed.

Referring to FIGS. 11–14, the joint 70 contemplates flat, shouldered surface 71 on lower part 67 and a corresponding flat, shouldered surface 72 on upper part 66. At opposite ends of surface 71 are tongue 73 and groove 74. The surface 72 has a groove 75 and tongue 76. When the shoulders are engaged as shown in FIG. 1, the flat surfaces mate, while tongue 73 and groove 75 fit together and the tongue 76 and groove 74 fit together. In this condition, the drive holes 77 in the lower part are aligned with the drive holes 78 in the upper part so as to receive rivets or drive pins (not shown). Thus, the upper and lower parts are rigidly but removably held together.

After the desired shaft length has been selected, the spring force can be further adjusted by means of the position of the retainer 55. This is particularly useful where it is necessary to make compensation at assembly. The adjusting procedure is explained below.

Figure 8:
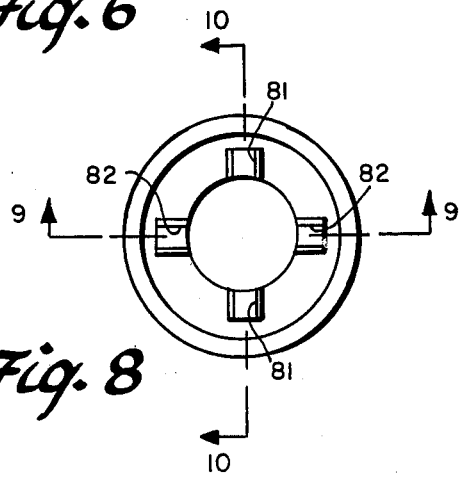
FIG. 8 is an enlarged plan view of the top of the hinge of FIG. 1.
Figure 10:
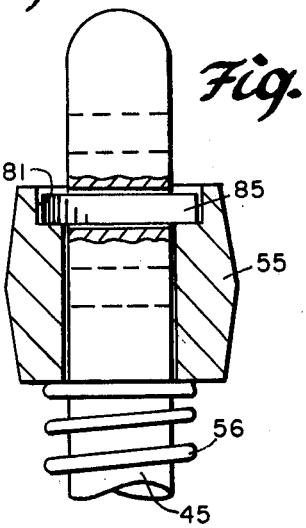
FIG. 10 is a fragmentary elevational view taken along the lines 10—10 of FIG. 8.
Figure 9:
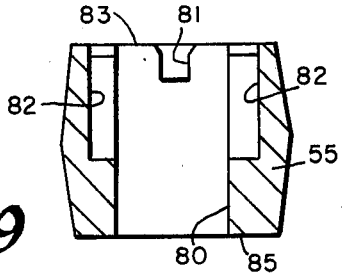
FIG. 9 is a fragmentary elevational view taken along the lines 9—9 of FIG. 8 with certain parts omitted.

With reference to FIGS. 8–10, the retainer is in the form of a sleeve having an axially extending bore 80 which accomodates the shaft 45. A pair of opposed slots 81 and a pair of opposed slots 82 extend along the bore 80 inwardly from top end 83. The pair 82 extends inwardly a greater distance than pair 81. The top part 66 of the shaft 45 is provided with a plurality of apertures 84*a*, 84*b* and 84*c*.

For assembly purposes, the spring 56 is placed over the shaft 45 and the bottom end 85 of the retainer made to engage the top end of the spring. The retainer is moved down over the shaft (compressing the spring) until the end 83 clears the apertures 84. Then a pin 85 is placed in one of the apertures 84. The retainer is allowed to move upwardly and rotated until either the slot pair 81 or 82 receive the pin. The retainer, hence the top end of the spring, will now be fixed.

For maximum compression, the pin is placed in the lower aperture 84c and is received in slots 81. For minimum compression, the pin is placed in the upper aperture 84a and is received in slots 82. There are in-between combinations. It will be seen, therefor, that the arrangement provides for vernier adjustment of spring force.

The manner in which the hinge functions will now be described:

First, however, we want to comment generally on the spring and door weight forces. The force generated by the weight of the door is represented by vector $F_1$ (FIG. 2). This force acts thru the moment arm $A_1$ and causes a torque about the pivot means 30 tending to rotate the door to the open position. The length of the moment arm $A_1$ will, of course, vary with the pivotal position of the door. The force generated by the spring 56 is represented by vector $F_2$ operating thru moment arm $A_2$ to create a torque about the pivot means 30 tending to rotate the door toward the closed position. The force generated by the spring will vary as noted below. It will be understood that the length of the vectors are for descriptive purposes and do not necessarily represent magnitudes.

In FIGS. 1, 2 and 3 it will be recalled that the main pivot 30 provides for the housing 5 hence the door 1 and the other described components to pivot or tilt as between the closed, broil and open positions.

In the closed position of FIG. 1, the member 57 has moved the detent roller 58 into engagement with the detent 59. In this position the member 57 is raised so that the slot 63 at lower end of the member 57 is spaced away from top of the shoulder 65 of the main pivot 30. The collar 34 and therefore the lower end of the spring 56 are held fixed by virtue of the roller 58 in detent 59. The spring is compressed between the collar 34 and retainer 55. The shaft control 47 has moved shaft 45 so that spring compression is minimum but sufficient to cause the roller 58 to tightly engage detent 59 and hold the door firm.

If the door is pulled away from the closed position, the roller 59 resists. Enough pull on the door must be employed so that the roller 59 rides up over the hump 59a, pushing the member 57 and collar 34 up with it, the rise being permitted by spring 56 being slightly compressed.

The parts are designed so that when the door has been titled about 20% from the vertical (FIG. 2) the following conditions are established: the shaft control 47 has pulled the shaft 56 down into the housing; the member 57 is firm against main pivot 30 by that the upper end of slot 63 engages the shoulder 65 so that the collar 34 and therefore the lower end of the spring 56 are held fixed; the spring remains compressed between collar 34 and retainer 55; the member 57 has positioned the roller against the detent 60.

The spring 56 is more compressed in FIG. 2 than in FIG. 1. The torque generated as the result of the compression is greater than the torque generated by the weight of the door so the door is urged toward the closed position. Thus, the force of the spring functions to push the collar 58 tight against the detent surface 60 but is not sufficient to force the roller up over the hump 59a into detent 59.

As the door is further moved toward the open position, the shaft control 47 continues to pull the shaft axially and further compress the spring 56. The force generated by the spring is further increased. This increase compensates for the increase in the length of arm $A_1$ which creates door-weight torque. Thus, the door is counter-balanced as it moves from broil-position to open position.

As will be understood, when the door is moved from the open position toward the closed position, action or operation is the reverse of that described.

We claim:

1. In a hinge to be secured to an oven door;

a housing to be fixedly secured to the oven door;

arm means for demountably securing the door to the oven;

main pivot means securing said arm to said housing and providing for pivoting of the door as between closed, broil, and open positions;

a compression spring;

first means connected between one end of said spring and said arm including mechanism to condition the first means to accomodate said pivoting of the door;

second means connected between the opposite end of said spring and said main pivot including mechanism to accomodate said pivoting of the door, the spring being compressed between the first and second means;

means forming a closed position detent and a broil position detent;

roller means connected to said second means for engaging said detents to establish the closed and broil positions;

said first and second means being operative as a function of the pivotal position of the door:

(a) to place said roller against one of said detents and compress the spring and transmit force of the same to cause the roller to tightly engage the detent and establish the closed or broil position;

(b) to compress or de-compress said spring and transfer the force of same to said door in opposition to the force developed by the weight of the door and thereby provide for counter-balancing.

2. In a hinge to be secured to an oven door;

a housing to be fixedly secured to the door;

arm means for demountably securing the door to the oven;

main pivot means securing said arm to said housing and providing for pivoting of the door as between closed, broil and open positions;

an elongated shaft, the axis of which is spaced from said main pivot means, mechanism on one end of said shaft mounting the shaft in said housing and permitting axial shifting of the shaft;

a retainer on the opposite end of said shaft;

a compression spring compressed between said retainer and said mechanism;

first means connected between said mechanism and said arm;

second means connected between said mechanism and said main pivot; and said first and second means being operative as a function of the pivotal position of the door to axially shift said shaft whereby to control the amount of compression of said spring and thereby provide a force to counter-balance the force of the weight of the door.

3. The hinge of claim 2 wherein:

said shaft is comprised of an upper part and a lower part and one each of each part having a flat, axially extending mounting surface with the surfaces engaging one another, said structure providing that the shaft can be lengthened or shortened by a longer or shorter upper part; and aligned apertures formed on said ends and means in said apertures securing the surfaces together.

4. A counterbalancing hinge for mounting a door on an oven compressing;

a housing to be fixedly secured to an oven door;

arm means for demountably securing the door to the oven;

main pivot means securing said arm to said housing to provide for pivoting of the door as between closed, broil and open positions.

an elongated shaft, the axis of the shaft being placed from said main pivot;

mechanism mounting the shaft in said the housing and permitting axial shifting of the shaft;

a first link pivotally connected between the end of said shaft and said arm, the pivot connection with said arm being located on the opposite side of the shaft axis as the main pivot means;

a retainer on the shaft;

a second link connected between said mechanism and said main pivot means including a sliding connection to provide for the second link to engage the main pivot means;

roller means on said link;

means on said arm forming a closed position detent and a broil position detent to be engaged by said roller;

a compression spring surrounding said shaft and compressed between said mechanism and retainer, the spring by acting on said retainer urging the shaft in a direction away from said first link and being restrained by the first link and the spring by acting on said mechanism urging the mechanism and said second link in the opposite direction, the mechanism and second link being restrained either by the second link engaging the main pivot or by the roller engaging a detent as a function of the pivoted position of the door; and said first link being effective to cause the shaft to shift axially as a function of the pivotal position of the housing to space said retainer and said mechanism closer or farther apart and compress or decompress the spring to increase or decrease the force developed thereby and the pulling force of the spring and said mechanism being transferred to said door to cause the door to pivot toward the closed position and thereby provide said counter balancing force.

5. In a stove having an oven opening and a door for the opening, a pair of hinges to detachably mount the door on the stove and being operative when so mounted to provide for the door to pivot as between closed, broil and open positions and provide for counter-balancing the door between broil and open positions each hinge comprising:

an elongated housing to be inserted into retaining means on the oven door and means providing for securing the hinge in position;

an arm having an inboard section and an outboard section, the inboard section being adapted to be inserted in a retaining socket on the stove and to be rigidly but releasably held therein for mounting the hinge and door on the stove;

main pivot means connecting said housing and said outboard section and providing for the housing to pivot relative to the outboard section to permit said door to pivot as between said closed, broil and open positions;

a collar slidably mounted in said housing for axial shifting along same and substantially confined against lateral shifting and formed with an axially extending aperture, the collar partaking of said pivoting motion of the housing;

an elongated shaft mounted in said collar aperture and extending in one direction into said housing and extending in the opposite direction away from the housing, the shaft partaking of said pivoting motion of the housing and the axis of the shaft being inboard of said main pivot;

a shaft control member;

mechanism pivotally connecting one end of the shaft control member to the position of shaft extending into said housing and pivotally connecting the other end of the shaft control member to said outboard section, the latter connection being inboard of the axis of the shaft, said mechanism partaking of said pivoting motion of the housing and transmitting spring reaction to the housing to provide a force on the door to counter-balance the force developed by the weight of the door;

an elongated collar control member carrying roller means;

means on said arm outboard section forming a closed-position detent and a broil-position detent to be engaged by said roller;

one end of said collar control member being connected to said collar for axially shifting therewith and the opposite end being engageable and disengageable with said main pivot means, the shifting and engagement and disengagement being provided by a sliding connection;

a retainer mounted on said end of the shaft extending away from the collar;

a compression spring surrounding said shaft and compressed between said collar and said retainer, the spring by acting on the retainer urging the shaft in a direction away from said shaft control member and being restrained by the shaft control member and the spring by acting on the collar urging the collar and collar control member in the opposite direction, the collar and collar control member being restrained either by the roller engaging one said detents or the end of the collar control member engaging said main pivot as a function of the pivotal position of the door;

said mechanism and said shaft control member causing the shaft to shift axially as a function of the pivotal position of the housing to space the retainer and collar closer or farther apart and compress or decompress the spring to increase or decrease the force developed thereby;

the structure of said components providing that:

(a) in the closed position, the collar control member being disengaged from said main pivot and said roller means being engaged with the closed-position detent and held against same by the force of said spring whereby to establish the closed position of said door;

(b) in the broil position, the collar control member being engaged with said main pivot and said roller means engaged with said broil position detent and being held against same by the force of said spring whereby to establish the broil-position of said door;

(c) and in all other positions the roller being disengaged from said detents and said collar control means being engaged with said main pivot and being held agaist same by the force of said spring whereby said spring exerts a pulling force on said mechanism and pushes the same against said housing in a direction to cause the housing to pivot toward the closed position and thereby provide said counter-balancing force;

and the movement of the roller between said detents, and the engaging and disengaging of the collar control member with said main pivot being accomodated by said axial shifting of the collar and the collar control member.

6. The hinge of claim 5 wherein said mechanism comprises:

first pivot means pivotally connecting one end of the shaft control member to said outboard section, the first pivot means being located inboard of the axis of said shaft;

second pivot means pivotally connecting the opposite end of the shaft control member to the portion of the shaft extending into said housing;

means on said second pivot means making a sliding fit with interior of the housing whereby to confine the end of the shaft against lateral displacement, to transmit spring reaction to the housing to provide a force on the door to counter-balance the force developed by the weight of the door and to cause said shaft control member to pivot about the first pivot means when the housing pivots;

7. The hinge of claim 5 wherein said housing is U-shaped in cross section and has a pair of sides, a back provided with a slot to accomodate passage of said shaft control member and said inboard section and an open front section provided with a pair of flanges retaining said collar and said sides each having a pivot bracket forming in part of said pivot means.

8. The hinge of claim 5 wherein said main pivot means further includes:

a pivot pin mounted on said pivot brackets and first and second spacer means mounted on said pin and each engaging said housing, said inboard section being mounted on said pin and positioned thereon by said spacers.

9. The hinge of claim 8 wherein said sliding connection comprises a slot formed on an end of said collar control member, the second spacer having a shoulder disposed in said slot and making a sliding fit therewith;

10. The hinge of claim 9 wherein said collar has:

a first pair of slider sections respectively engaging said back and sides of the housing;

a second pair of slider sections respectively engaging the flanges and sides of the housing;

a retaining slot receiving one end of said collar control member; and a socket mounting one end of said compression spring;

11. The hinge of claim 5 wherein:

said shaft is comprised of an upper part and lower part one end of each part having a flat, axially extending mounting surface with the surfaces engaging one another, said structure providing that the shaft can be lengthened or shortened by a longer or shorter upper part; and aligned apertures formed on said ends and means in said apertures securing the surfaces together.

12. The hinge of claim 5 wherein the end of the upper part of the shaft has a plurality of axially spaced pin apertures and said retainer comprises:

a sleeve having a first pair of oppositely disposed slots extending axially from one edge and a second pair of oppositely disposed slots extending axially from said one edge, the first pair extending an axial distance greater the second pair and a pin disposed in one of said pin apertures and in one pair of said slots whereby to maintain the retainer on the shaft against the force of said spring, said pin apertures and slots providing a means to adjust the distance between the collar and the retainer whereby to adjust the amount of spring compression;

13. The hinge of claim 12 wherein the shaft is ribbed.

14. In a hinge to be secured to an oven door;

a housing to be fixedly secured to the door;

arm means for demountably securing the door to the oven;

main pivot means securing said arm to said housing and providing for pivoting of the door as between closed, broil and open positions;

an elongated shaft, the axis of which is spaced from said main pivot means, mechanism mounting the shaft in said housing and permitting axial shifting of the shaft;

a retainer on said shaft;

a compression spring compressed between said retainer and said mechanism;

first means connected between said mechanism and said arm;

second means connected between said mechanism and said main pivot;

said first and second means being operative as a function of the pivotal position of the door to axially shift said shaft whereby to control the amount of compression of said spring and thereby provide a force to counter-balance the force of the weight of the door;

the end of the upper part of said shaft having a plurality of axially spaced pin apertures; and said retainer comprising a sleeve having a first pair of oppositely disposed slots extending axially from one edge and a second pair of oppositely disposed slots extending axially from said one edge, the first pair extending an axial distance greater than the second pair and a pin disposed in one of said pin apertures and in one pair of said slots whereby to maintain the retainer on the shaft against the force of said spring, said pin apertures and slots providing a means to adjust the distance between said end and said mechanism to adjust the amount of spring compression.

* * * * *